US010918231B1

(12) United States Patent
Jain

(10) Patent No.: US 10,918,231 B1
(45) Date of Patent: Feb. 16, 2021

(54) TEMPERATURE REGULATING BEVERAGE CONTAINER LID

(71) Applicant: Sanjeev Jain, Vancouver, WA (US)

(72) Inventor: Sanjeev Jain, Vancouver, WA (US)

( * ) Notice: Subject to any disclaimer, the term of this patent is extended or adjusted under 35 U.S.C. 154(b) by 0 days.

(21) Appl. No.: 16/879,317

(22) Filed: May 20, 2020

(51) Int. Cl.
*A47G 19/22* (2006.01)

(52) U.S. Cl.
CPC ..... *A47G 19/2272* (2013.01); *A47G 19/2288* (2013.01)

(58) Field of Classification Search
CPC ..... B65D 2543/00046; B65D 2543/00092; B65D 2543/00537; B65D 47/06; A47G 19/2288; A47G 21/187
See application file for complete search history.

(56) References Cited

U.S. PATENT DOCUMENTS 3,241,724 A * 3/1966 Lerner ..... B65D 51/24 222/146.3
5,964,379 A * 10/1999 DeMars ..... A47G 19/2288 220/710.5
6,176,390 B1 1/2001 Kemp
6,571,973 B1 6/2003 Tripsianes
9,457,948 B2 10/2016 Savenok
10,159,369 B2 12/2018 MacDonald
2005/0205588 A1 9/2005 Pitts
2008/0302822 A1* 12/2008 Tetreault ..... F25D 3/08 222/146.6
2012/0080441 A1* 4/2012 Lin ..... B65D 47/06 220/810
2016/0100704 A1* 4/2016 Ramzan ..... B65D 43/0212 222/190
2018/0305091 A1 10/2018 Krafft
2019/0375559 A1* 12/2019 Spivey ..... B65D 51/1611

* cited by examiner

*Primary Examiner* — Shawn M Braden
(74) *Attorney, Agent, or Firm* — Boudwin Intellectual Property; Daniel Boudwin

(57) ABSTRACT

A temperature regulating beverage container lid is provided. The device has a lid with a top surface, at least one annular sidewall, and an internal wall defining a drinking chamber and a ventilation chamber. The perimeter of the sidewall of the lid can secure over the brim of a beverage container. The drinking chamber has a floor and a drinking spout, the drinking spout in fluid communication with a tubular member. The tubular member, in turn, is in fluid communication with an aperture in the floor. The tubular member is surrounded by a material with a high thermal capacity. An aperture in the top surface of the lid provides ventilation while the ventilation chamber is sized to receive the drinking spout of an identical temperature regulating beverage container lid.

19 Claims, 3 Drawing Sheets

TEMPERATURE REGULATING BEVERAGE CONTAINER LID

BACKGROUND OF THE INVENTION

The present invention relates to beverage container lids. More particularly, the present invention provides for a removably securable beverage container lid with a high thermal capacity material. The present invention can cool portions of a liquid through transfer of heat between the liquid and the material in order to provide a more regulated temperature to a user.

Many people purchase beverages which are served at a temperature that is not conducive to immediate consumption. Some beverages, such as hot coffee may burn an individual's mouth if consumed immediately. Often such beverages include warnings on the packaging alerting the individual that such a product may not be initially safe. Other beverages, such as smoothies, are too cold for initial consumption, and may cause pain to individuals with sensitive teeth. The individual must typically wait for the temperature of the beverage to normalize to a more comfortable and safe temperature before consumption. Waiting for a beverage to fall within a safe temperature range is not convenient and impatient individuals may forego the wait and risk their safety.

Devices have been disclosed in the known art that relate to beverage container lids. These include devices that have been patented and disclosed in patent application publications. However, the devices in the known art have several drawbacks. Typically, beverage container lids only serve to keep the beverage within the beverage container. These lids do not aid in regulating the temperature of the beverage inside. Additionally, such devices typically have small air vents which can often get blocked by bubbles and foam, especially in drinks such as a latte, which then inhibits and blocks the flow of the beverage. These devices also tend to have small openings through which the beverage flows into the individual's mouth, thereby often leading to spillage.

The present invention substantially diverges in design elements from the known art and consequently it is clear that there is a need in the art for an improvement to existing beverage container lids. In this regard the present invention substantially fulfills these needs.

SUMMARY OF THE INVENTION

In view of the foregoing disadvantages inherent in the known types of beverage container lids now present in the art, the present invention provides a removably securable beverage container lid with a high thermal capacity material. The present invention can cool portions of a liquid through transfer of heat between the liquid and the material in order to provide a more regulated temperature to a user. The present invention also includes a wide spout for easy consumption of the beverage as well as a ventilation chamber that provides for a smooth and continuous flow of the beverage without inhibition or blockage. The present temperature regulating beverage container lid comprises a lid with a top surface, at least one annular sidewall, and an internal wall defining a drinking chamber and a ventilation chamber. The perimeter of the sidewall of the lid can secure over the brim of a beverage container. The drinking chamber has a floor and a drinking spout, the drinking spout in fluid communication with a tubular member. The tubular member, in turn, is in fluid communication with an aperture in the floor. The tubular member is surrounded by a material with a high thermal capacity. An aperture in the top surface of the lid provides ventilation while the ventilation chamber is sized to receive the drinking spout of an identical temperature regulating beverage container lid.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
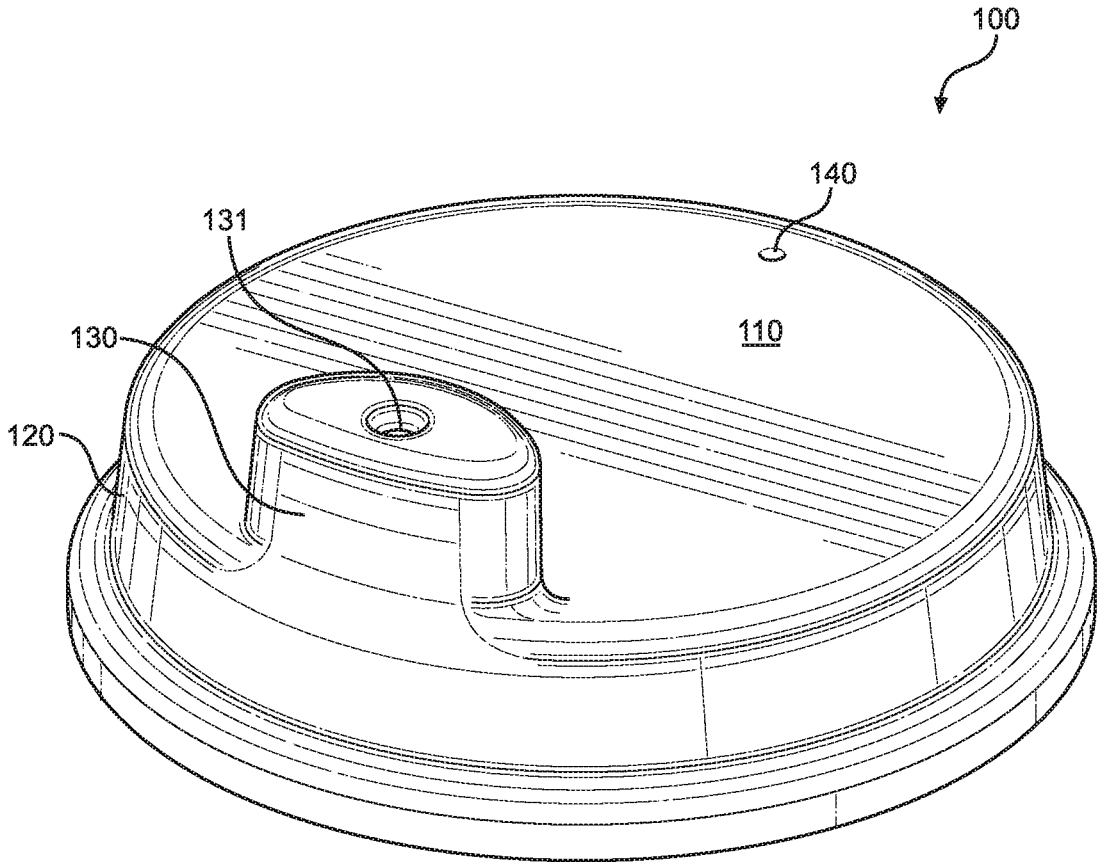
FIG. 1 shows a perspective view of an embodiment of the temperature regulating beverage container lid.

Reference is made herein to the attached drawings. Like reference numerals are used throughout the drawings to depict like or similar elements of the temperature regulating beverage container lid. For the purposes of presenting a brief and clear description of the present invention, a preferred embodiment will be discussed as used for the temperature regulating beverage container lid. The figures are intended for representative purposes only and should not be considered to be limiting in any respect.

Referring now to FIG. 1, there is shown a perspective view of an embodiment of the temperature regulating beverage container lid. The temperature regulating beverage container lid 100 comprises a lid which has a top surface 110 and at least one annular sidewall 120. In the shown embodiment, the annular sidewall 120 is disposed perpendicular to the top surface 110. In other embodiments, the annular sidewall 120 is disposed downwardly from the top surface 110 at an angle or contour in order to suit a desired aesthetic. The temperature regulating beverage container lid 100 is sized to fit over a perimeter of a beverage container such as a paper or Styrofoam cup, a drinking glass, a plastic cup, a mason jar, or the like. In the shown embodiment, the temperature regulating beverage container lid 100 comprises a circular cross-section in order to fit over a brim of a standard drinking cup. In one embodiment (shown in FIG. 3), the perimeter of the sidewall 120 of the lid secures over a brim (see FIG. 3, 340) of a beverage container (see FIG. 3, 341) via complementary threadings (see FIG. 3, 350).

A drinking spout 130 extends upwardly from the top surface 110 of the lid. In the shown embodiment, the drinking spout 130 is a wide protrusion that extends from the planar top surface 110 of the lid. The drinking spout 130 has a drinking aperture 131 through which liquids can flow. In the shown embodiment, the drinking aperture 131 comprises a circular cross-section and is disposed in a middle edge of the drinking spout 130. In other embodiments, the drinking aperture 131 is a variety of sizes and shapes in order to accommodate various flow rates anticipated in the use of the device. In the shown embodiment, the drinking aperture 131 is small in relation to the drinking spout 130 in order to provide a slow flow rate. The slow flow rate helps to insure that a user takes small sips or drinks of the beverage at a time, thereby enabling a material with a high thermal capacity disposed within the device to alter the temperature of the liquid flowing therethrough, as described in more detail below. By increasing the size of the drinking aperture 131, the volume of beverage taken in by a user's sip of the beverage can be adjusted. The drinking spout 130 also aids in reducing and eliminating spillage as the drinking spout 130 can comfortably fit within a user's mouth.

The top surface 110 of the lid also includes a ventilation aperture 140. The ventilation aperture 140 enables air to flow through the device. When the device is secured over a beverage container, the ventilation aperture 140 enables a user to drink a beverage via the drinking aperture 131 by allowing air to flow through the device, uninterrupted and uninhibited by the beverage or any foam, bubbles, or the like. As the top surface 110 of the lid, and therefore the ventilation aperture 140 are elevated above the brim of the beverage container by function of the sidewall 120, the ventilation aperture 140 is separated from such foam, bubbles, or the like that may be present in the beverage.

Figure 2:
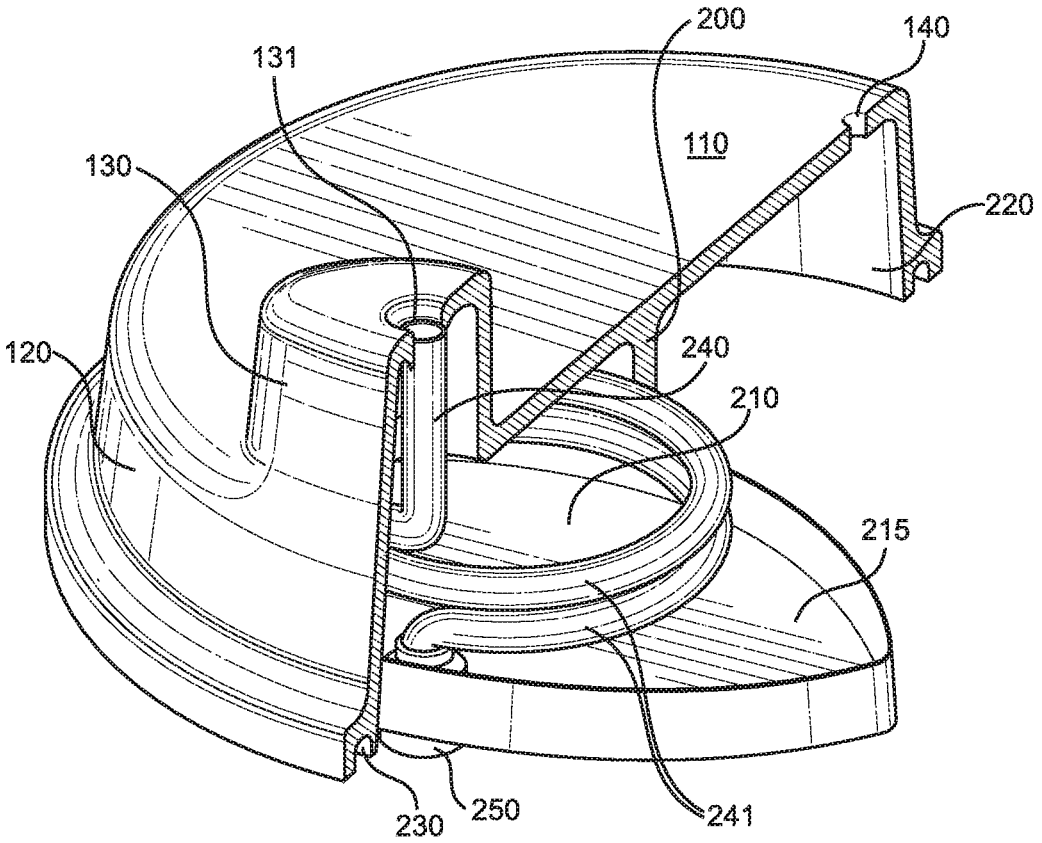
FIG. 2 shows a perspective view of a partial cross-section of an embodiment of the temperature regulating beverage container lid.

Referring now to FIG. 2, there is shown a perspective view of a partial cross-section of an embodiment of the temperature regulating beverage container lid. An internal wall 200 defines a drinking chamber 210 and a ventilation chamber 220. In the shown embodiment, the internal wall 200 is vertically disposed downwards and is perpendicular to the top surface 110 of the lid. The internal wall 200 subdivides the space underneath the top surface 110 of the lid to compartmentalize the device. The drinking chamber 210 further comprises a floor 215 thereby defining a drinking chamber interior volume. In contrast, the ventilation chamber 220 does not have a floor and is an open chamber. The ventilation aperture 140 is disposed above the ventilation chamber 220 wherein the ventilation aperture 140 is in fluid communication with the ventilation chamber 220. In this manner, when the device is secured to a beverage container, air from outside the device can be drawn into the beverage container through the ventilation aperture 140 when a user drinks from the drinking aperture 131 of the drinking spout 130. This enables air pressures to normalize and eliminate a potential increased pressure inside the beverage container, absent a ventilation aperture 140, which would make drinking from the beverage container more and more difficult.

The ventilation chamber 220 is sized to receive the drinking spout 130 of an identical temperature regulating beverage container lid. In a further embodiment, the ventilation chamber 220 is also shaped to receive the drinking spout 130 of an identical temperature regulating beverage container lid. In another further embodiment, the ventilation chamber 220 is sized and shaped to mimic and to receive the size and shape of the drinking spout 130 of an identical temperature regulating beverage container lid. In this manner, the drinking spout 130 of one device can nest within the ventilation chamber 220 of an identical other device. This nesting provides and efficient and clean manner in which a plurality of devices can be stored when not in use. In such a configuration, multiple devices can be stacked on top of each other, in an alternating pattern, in order to reduce the amount of storage space needed. Such reduced storage space is desirable in situations such as store counters and shelves where storage and display space are limited.

Figure 3:
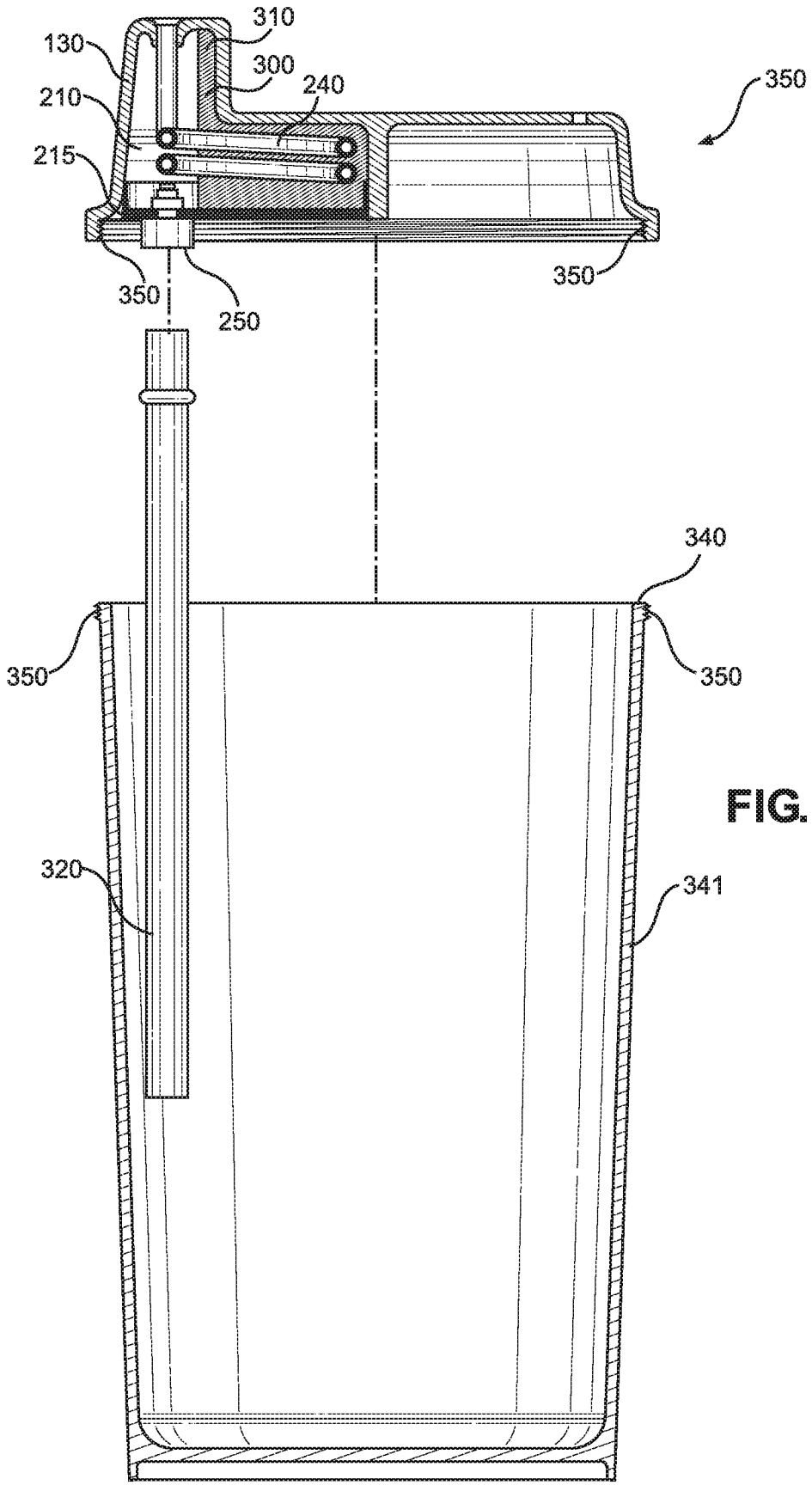
FIG. 3 shows an exploded cross-sectional view of an embodiment of the temperature regulating beverage container lid in use.

A perimeter of the sidewall 120 of the lid is configured to secure over a brim of a beverage container (as shown in FIG. 3, below). In the shown embodiment, the perimeter of the sidewall 120 includes a brim channel 230 which is sized and shaped to receive the brim of the beverage container. The brim channel 230 enables the device to secure over the brim of the beverage container via friction fit. One of ordinary skill in the art will understand how a variety of beverage container brims can be received by the brim channel 230 by adjusting the size, width, and shape of the brim channel 230 to accomplish such a friction fit. In a further embodiment, the mating of the brim channel 230 to the brim of the beverage container forms a liquid-tight seal such that the beverage will not seep or spill through the union of the brim channel 230 and the brim of the beverage container.

A tubular member 240 is disposed within the drinking chamber 210 interior volume, wherein the tubular member 240 is in fluid communication with the aperture of the drinking spout 130 and with a floor aperture 250. The tubular member 240 is hollow and provides a pathway for the beverage to travel, when the device is secured to the beverage container, through the drinking spout 130 and the drinking aperture 131. In the shown embodiment, the tubular member 240 comprises at least one spiral section 241 in order to increase the amount of surface area through which the beverage will travel. The increased surface area provides a greater heat transfer between the beverage and the material with a high thermal capacity disposed within the drinking chamber 210 interior volume as more detailed below. It is contemplated by the present disclosure that varying lengths and widths of spiral section 241 can be utilized to maximize thermal transmission between a material (as shown in FIG. 3, 300) with a high thermal capacity and a beverage. It is also contemplated that multiple spiral sections 241 can be utilized. The spiral section 241, in addition to providing a higher amount of surface area, also slows the flow of the beverage through the tubular member 240 thereby enabling a greater thermal transmission.

Referring now to FIG. 3, there is shown an exploded cross-sectional view of an embodiment of the temperature regulating beverage container lid in use. A material 300 with a high thermal capacity is disposed within the drinking chamber 210 interior volume. One of ordinary skill in the art will understand that thermal capacity is the property of a material to absorb heat when the material is heated, and to release heat when the material is cooled. In one embodiment, the material 300 is water. In another embodiment, the material 300 is a gel. The material 300 surrounds the tubular member 240. In a further embodiment, the material 300 is further disposed within an interior portion 310 of the drinking spout 130. In one embodiment, the material 300 surrounds the tubular member 240 and fills the space of the entire drinking chamber 210 except for the tubular member 240 and the space inside the tubular member 240.

The tubular member 240 is composed of a material that facilitates the transfer of heat between the material 300 with a high thermal capacity and the beverage. As the beverage travels through the tubular member 240, the temperature is normalized to a safer range. In situations where the beverage is a hot beverage, the material 300 with a high thermal capacity absorbs some of the heat from the beverage, thereby cooling the beverage. In situations where the beverage is a cold beverage, the material 300 with a high thermal capacity radiates heat to the beverage, thereby heating the beverage. It is contemplated that the material 300 with a high thermal capacity can be stored at room temperature, and that the differential in temperatures between the material 300 and the beverage enables heat to be transferred. It is also contemplated that the present device can be heated or cooled in order to generate a higher differential in temperatures between the material 300 and the beverage. The material 300 is able to transfer heat one sip at a time. Although it is not contemplated that the material 300 will heat or cool the entire beverage, it is contemplated that by regulating the flow of the beverage, by the time the temperature differential between the material 300 and the beverage is minimal, the beverage will have normalized to a safe drinking temperature by exposure of the beverage container to the outside air.

The beverage can be consumed via utilization of the present device either by gravity flow or through the use of a straw 320. In one use, a straw 320 is not needed as the user can tip the beverage container such that the beverage is in fluid communication with the floor aperture 250. The user can then sip the beverage through application of suction to the drinking spout 130 causing the beverage to flow through the tubular member 240 which is in thermal communication with the material 300 with a high thermal capacity.

In some embodiments, the floor aperture 250 is configured to receive a removably securable straw 320. In further embodiments, the straw 320 can be friction fitted to the floor aperture 250. In another further embodiment, the mating of the straw 320 with the floor aperture 250 forms a waterproof seal such that suction is maintained when the user utilizes the straw 320 to drink through the device. In some embodiments, the straw 320 can be specifically tailored to the present invention, while in other embodiments, such as the shown embodiment, the straw 320 can be a standard drinking straw. In other embodiments, the straw 320 can be permanently secured to the floor aperture 250, wherein the permanently secured straw 320 is disposed downwardly from the floor 215 and the straw 320 is in fluid communication with the tubular member 240.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A temperature regulating beverage container lid, comprising:

a lid comprising a top surface, at least one annular sidewall disposed perpendicular to the top surface, and an internal wall defining a drinking chamber and a ventilation chamber;

a perimeter of the sidewall of the lid configured to secure over a brim of a beverage container;

the drinking chamber further comprising a floor thereby defining a drinking chamber interior volume;

a drinking spout extending upwardly from the top surface of the lid;

a tubular member disposed within drinking chamber interior volume, wherein the tubular member is in fluid communication with the drinking spout and with a floor aperture;

a material disposed within the drinking chamber interior volume;

wherein the material is a gel;

the material surrounding the tubular member;

a ventilation aperture in the top surface of the lid disposed above the ventilation chamber, wherein the ventilation aperture is in fluid communication with the ventilation chamber; and the ventilation chamber sized to receive the drinking spout of an identical temperature regulating beverage container lid.

2. The temperature regulating beverage container lid of claim 1, wherein the internal wall is vertical and disposed perpendicular to the top surface of the lid.

3. The temperature regulating beverage container lid of claim 1, wherein the perimeter of the sidewall secured over a brim of a beverage container via friction fit.

4. The temperature regulating beverage container lid of claim 1, wherein the tubular member comprises a plurality of spiral sections.

5. The temperature regulating beverage container lid of claim 1, wherein the floor aperture is configured to receive a removably securable straw.

6. The temperature regulating beverage container lid of claim 1, wherein the material is further disposed in an interior portion of the drinking spout.

7. The temperature regulating beverage container lid of claim 1, wherein the ventilation chamber is sized and shaped to mimic and to receive the size and shape of the drinking spout of an identical temperature regulating beverage container lid.

8. A temperature regulating beverage container lid, comprising:

a lid comprising a top surface, at least one annular sidewall disposed perpendicular to the top surface, and an internal wall defining a drinking chamber and a ventilation chamber;

a perimeter of the sidewall of the lid configured to secure over a brim of a beverage container;

the drinking chamber further comprising a floor thereby defining a drinking chamber interior volume;

a drinking spout extending upwardly from the top surface of the lid;

a tubular member disposed within drinking chamber interior volume, wherein the tubular member is in fluid communication with the drinking spout and with a floor aperture;

a straw permanently secured to the floor aperture, disposed downwardly from the floor, in fluid communication with the tubular member;

a material disposed within the drinking chamber interior volume;

the material surrounding the tubular member;

a ventilation aperture in the top surface of the lid disposed above the ventilation chamber, wherein the ventilation aperture is in fluid communication with the ventilation chamber; and the ventilation chamber sized to receive the drinking spout of an identical temperature regulating beverage container lid.

9. The temperature regulating beverage container lid of claim 8, wherein the internal wall is vertical and disposed perpendicular to the top surface of the lid.

10. The temperature regulating beverage container lid of claim 8, wherein the perimeter of the sidewall secured over a brim of a beverage container via complementary threadings.

11. The temperature regulating beverage container lid of claim 8, wherein the tubular member comprises a plurality of spiral sections.

12. The temperature regulating beverage container lid of claim 8, wherein the material is a gel.

13. The temperature regulating beverage container lid of claim 8, wherein the material further surrounds an interior portion of the drinking spout.

14. The temperature regulating beverage container lid of claim 8, wherein the ventilation chamber is sized and shaped to mimic and to receive the size and shape of the drinking spout of an identical temperature regulating beverage container lid.

15. A temperature regulating beverage container lid, comprising:

a lid comprising a top surface, at least one annular sidewall disposed perpendicular to the top surface, and an internal wall defining a drinking chamber and a ventilation chamber;

a perimeter of the sidewall of the lid configured to secure over a brim of a beverage container via complementary threadings;

the drinking chamber further comprising a floor thereby defining a drinking chamber interior volume;

a drinking spout extending upwardly from the top surface of the lid;

a tubular member disposed within drinking chamber interior volume, wherein the tubular member is in fluid communication with the drinking spout and with a floor aperture;

wherein the floor aperture is configured to receive a removably securable straw;

a material disposed within the drinking chamber interior volume;

the material surrounding the tubular member;

a ventilation aperture in the top surface of the lid disposed above the ventilation chamber, wherein the ventilation aperture is in fluid communication with the ventilation chamber; and the ventilation chamber sized to receive the drinking spout of an identical temperature regulating beverage container lid.

16. The temperature regulating beverage container lid of claim 15, wherein the tubular member comprises a plurality of spiral sections.

17. The temperature regulating beverage container lid of claim 15, wherein the material is a gel.

18. The temperature regulating beverage container lid of claim 15, wherein the material further surrounds an interior portion of the drinking spout.

19. The temperature regulating beverage container lid of claim 15, wherein the ventilation chamber is sized and shaped to mimic and to receive the size and shape of the drinking spout of an identical temperature regulating beverage container lid.

* * * * *